US007556692B2

(12) United States Patent
Metzger et al.

(10) Patent No.: US 7,556,692 B2
(45) Date of Patent: Jul. 7, 2009

(54) DEVICE FOR COATING A CONTINUOUS WEB OF MATERIAL

(75) Inventors: Rolf Metzger, Dietlikon (CH); Bruno Holtmann, Dielsdorf (CH); Arno Zindel, Gossau (CH)

(73) Assignee: Bachofen + Meier AG Maschinenfabrik, Bulach (CH)

( * ) Notice: Subject to any disclaimer, the term of this patent is extended or adjusted under 35 U.S.C. 154(b) by 351 days.

(21) Appl. No.: 10/552,822

(22) PCT Filed: Mar. 11, 2004

(86) PCT No.: PCT/EP2004/002481

§ 371 (c)(1),
(2), (4) Date: Oct. 6, 2005

(87) PCT Pub. No.: WO2004/089555

PCT Pub. Date: Oct. 21, 2004

(65) Prior Publication Data

US 2006/0201421 A1 Sep. 14, 2006

(30) Foreign Application Priority Data

Apr. 11, 2003 (DE) ..... 103 16 999

(51) Int. Cl.
*B05C 3/02* (2006.01)

(52) U.S. Cl. ..... 118/410; 118/419; 118/DIG. 4

(58) Field of Classification Search ..... 118/DIG. 4, 118/410, 419; 427/420; 425/466, 467, 190
See application file for complete search history.

(56) References Cited

U.S. PATENT DOCUMENTS

| | | | | |
|---|---|---|---|---|
| 3,632,403 A | | 1/1972 | Greiler | |
| 4,019,906 A | | 4/1977 | Ridley | |
| 4,135,477 A | | 1/1979 | Ridley | |
| 4,659,302 A | * | 4/1987 | Maejima | 425/190 |
| 5,575,851 A | | 11/1996 | Abe et al. | |
| 6,146,708 A | * | 11/2000 | Kamitani | 427/420 |
| 6,423,144 B1 | | 7/2002 | Watanabe | |
| 6,709,517 B1 | | 3/2004 | Holtmann et al. | |
| 7,081,163 B2 | | 7/2006 | Metzger | 118/410 |

FOREIGN PATENT DOCUMENTS

| | | |
|---|---|---|
| DE | 2 014 822 | 11/1970 |
| DE | 35 37 508 | 4/1986 |
| EP | 0 737 521 | 10/1996 |
| EP | 0 796 666 | 9/1997 |

* cited by examiner

*Primary Examiner*—Brenda A. Lamb
(74) *Attorney, Agent, or Firm*—Andrew Wilford

(57) ABSTRACT

Known devices for coating a continuous web of material (13) comprise a casting container (1) which consists of a casting surface (8) for the discharge of the coating material in a free falling curtain (C); at least one distribution chamber (2) which extends in a transversal manner in relation to the direction of circulation of the web of material and which comprises a supply line (10) for the coating material and an discharge slit (9) which discharges onto the casting surface (8), and two lateral guiding elements (7, 12) which extend in a downward direction for the edges of the curtain (C). According to the invention, the lateral guiding elements (7, 12) are curved on the upper end thereof corresponding to the course of the casting surface, (8) whereon (8) the lateral guiding elements are fixed in an adjustable transversal manner and the coating material supply line (10) leads into the valve chamber (2) in the central area of the casting container (1).

10 Claims, 5 Drawing Sheets

DEVICE FOR COATING A CONTINUOUS WEB OF MATERIAL

CROSS REFERENCE TO RELATED APPLICATIONS

This application is the US national phase of PCT application PCT/EP2004/002481, filed 11 Mar. 2004, published 21 Oct. 2004 as WO 2004/089555, and claiming the priority of German patent application 10316999.7 itself filed 11 Apr. 2003.

FIELD OF THE INVENTION

The present invention relates to an apparatus for coating a continuously moving web that has a liquid hopper in turn having:

a flow face for forming the coating material into a freely falling curtain, at least one distribution chamber extending transversely of the web-travel direction with an input for the coating material and an output slot on the pour surface, and two lateral downwardly extending guides for the edges of the curtain.

STATE OF THE ART

In order to coat a moving web, such as a paper or cardboard web or metal or plastic foil, so-called curtain coaters are known where the coating material (plastic dispersion, pigmented paint, etc.) issues from a slot nozzle as a free-falling curtain that impinges the web. If two or more layers are to be applied simultaneously, a so-called slide hopper is used where the various coats are first layered on a flow face one above the other and then drop together as a free-falling curtain. in order to ensure a stable coating width of the curtain, the two curtain edges are each guided by a guide extending from the liquid hopper adjacent the curtain. In the apparatus of this type described in U.S. Pat. No. 4,135,477 the guides are parts of side plates of the hopper.

A curtain coater is known from WO 01/047643 (U.S. Pat. No. 6,709,517) that makes it possible to vary the coating width over a wide range. To this end transversely movable splitter elements are provided on each side of the constant-width dropping curtain to separate out a curtain region. The split off coating material is conducted off. It must either be expensively recirculated or it is lost.

OBJECT OF THE INVENTION

It is thus an object of the invention so to improve a coating apparatus of the described type that different coating widths can be set without having to recirculate or dispose of the coating material.

SUMMARY OF THE INVENTION

This object is attained in that the lateral guides have upper ends shaped to conform to the flow face and are mounted to be transversely adjustable on the flow face, and that the coating-material input opens centrally in the hopper into the distribution chamber.

The solution of the invention makes it possible to set the width of the coating material on the flow face issuing from the outlet slot of the distribution chamber and the width of the curtain to the desired coating width. It is thus no longer necessary when reducing the coating width to split off parts of the curtain or take apart the nozzle.

Since at the ends of the guide elements near the web there are no splitters, the known elements for uniform application with straight and sharp coating edges can be provided for the web, as described in WO 02/081,103 (U.S. Pat. No. 7,081,163); for example a suction element to prevent formation of an edge bead.

BRIEF DESCRIPTION OF THE DRAWING

The drawing describes the invention with reference to several embodiments.

EMBODIMENTS OF THE INVENTION

Figure 1:
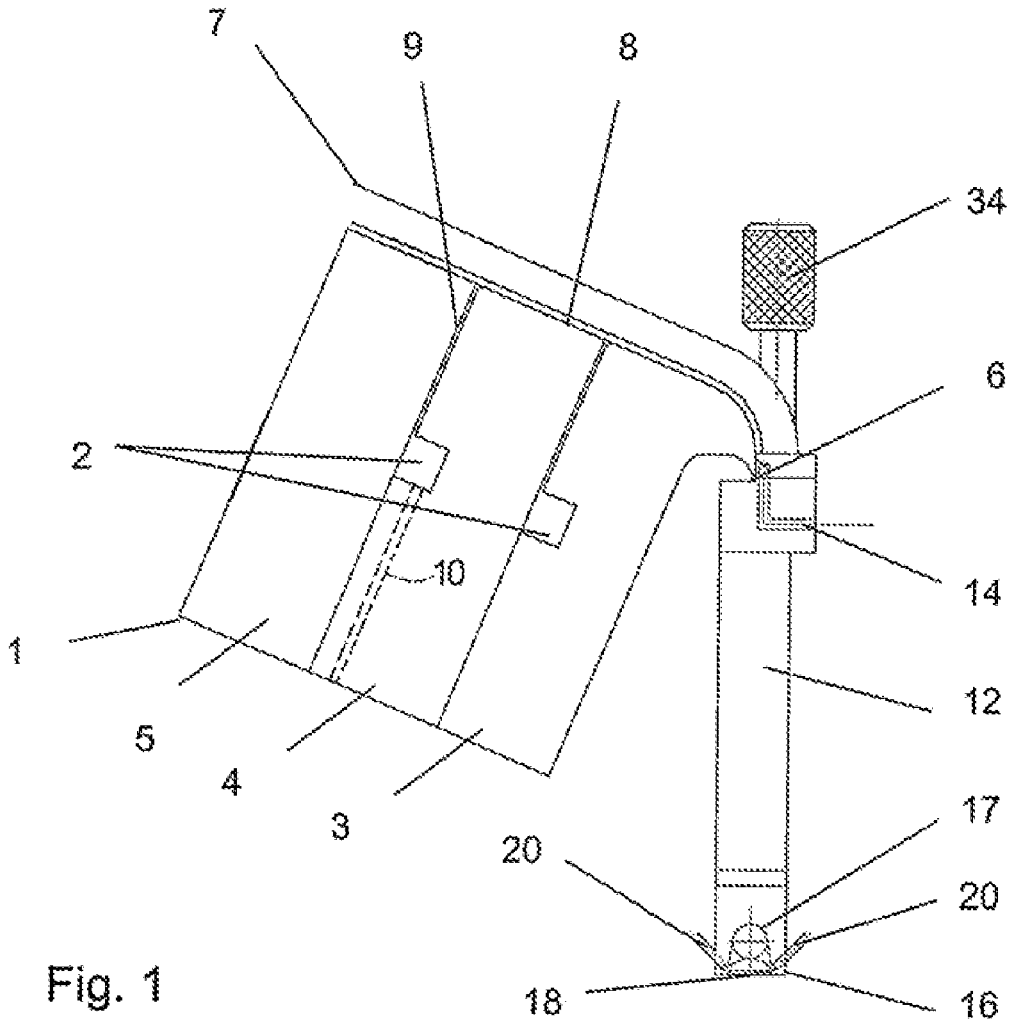
FIG. 1 is a section through a slide hopper with two distribution chambers for applying two coatings, one over the other.

The coating apparatus shown in the drawing serves for example in the manufacture of self-sticking labels or hard-foil strips for applying a dispersion-type adhesive and other layers to a support strip, for example a paper strip or a plastic foil. Because of its advantages, it can serve to apply other dispersions on webs of paper, metal, or plastic, for example to make packing material or ink-jet paper and to coat paper or cardboard webs with flow dies or microcapsules, as well as other special applications.

Figure 4:
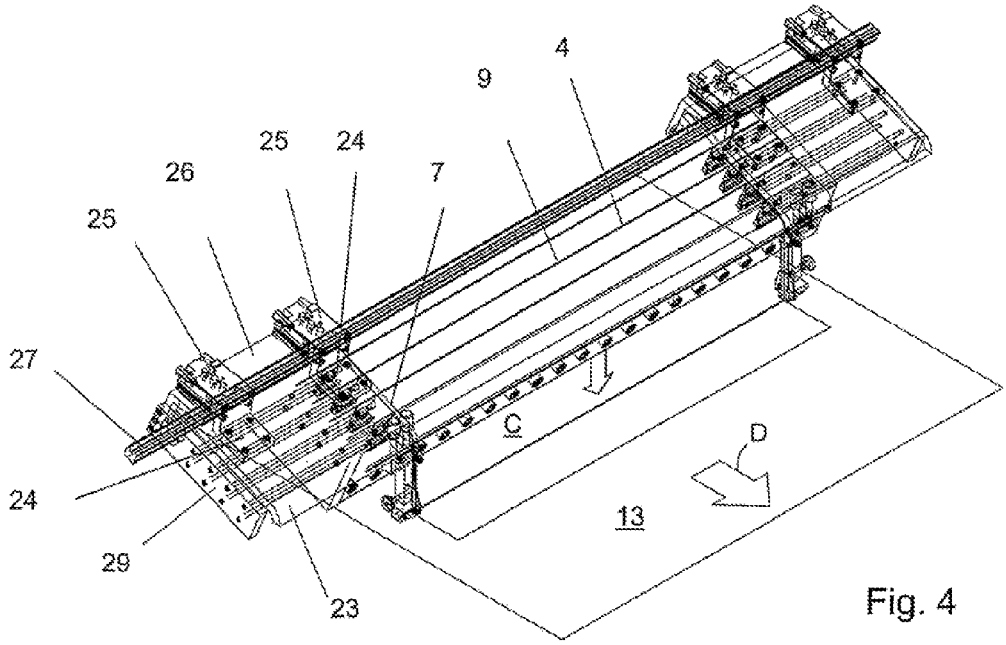
FIGS. 4 and 5 are perspective views of a slide hopper with four distribution chambers and a steplessly adjustable curtain width.

The coating device is constructed as a slide hopper and has a modularly constructed liquid hopper 1 having at least one distribution chamber 2 extending transversely of a web-travel direction D (FIG. 4). The liquid hopper 1 is comprised of three modules 3, 4, and 5 as shown in FIG. 1. The module 3 closest to the curtain is provided with an overflow edge 6 and has on the opposite side a recess that forms a first distribution chamber 2. Directly upstream of the module 3 is a further module 4 that on one side closes the distribution chamber 2 of the module 3 and that on the opposite side is formed with a second distribution chamber 2. The module 5 on one side seals the second distribution chamber 2 of the module 4 and on the other side closes the liquid hopper 1.

The upper surface of the liquid hopper 1 is formed as a flow face 8 inclined downward downstream and the various layers coming from the distribution chambers 2 lie on it. To this end each distributions chamber 2 has an outlet slot 9 extending the full length of the distribution chamber 2 and opening at the flow face 8. The coating materials are fed into the respective distribution chambers 2 via respective passages 10 that lie in central regions of the liquid hopper 1 at a sufficient spacing from the seal plates that laterally close the distribution chambers 2. They are connected at the lower side of the liquid hopper 1 to supply lines for the coating materials. The feed passages 10 preferably end relative to the web width exactly in the center of the respective distribution chambers 2 so that the coating material is uniformly distributed in the distribution chambers 2 regardless of the current coating width.

Figure 5:
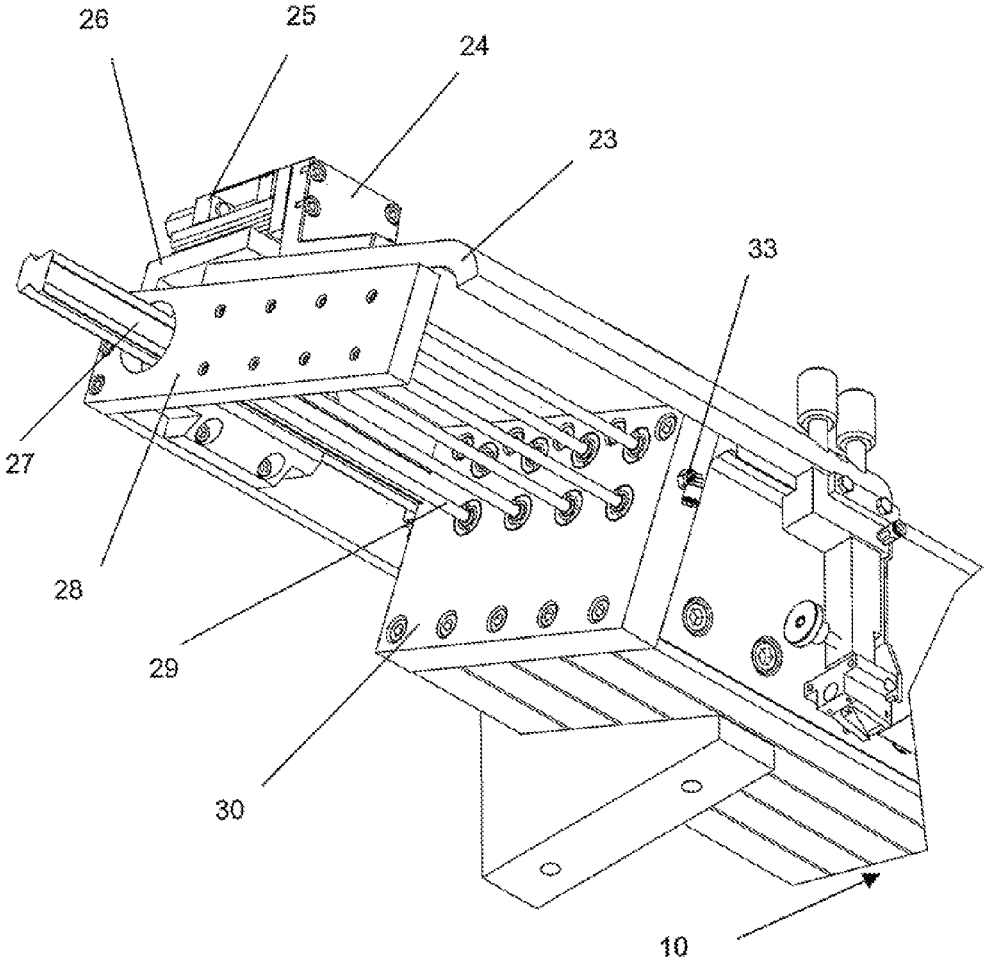

The liquid hopper 1 according to FIG. 1 has two distribution chambers 2 for applying two layers, the liquid hopper 1 according to FIGS. 4 and 5 has four distribution chambers 2 for applying four layers. The number of distribution chambers 2 is directly determined by the number of modules 3, 4, and 5.

The sides of the liquid hopper 1 are each provided with downwardly extending guides 7 and 12 for the respective curtain edge, each having an upper end conforming to the curvature of the flow face 8. Each pair of guides 7 and 12 extends along the flow face 8 and past its end then down parallel to the curtain C as shown in FIG. 4 to immediately adjacent a web 13 to be coated. The guides 7 and 12 can be shifted transversely and secured along the flow face 8, this transverse positioning being done either manually or automatically, e.g. via a pneumatic, electric, or hydraulic linear actuator. The guides 7 and 12 serve to prevent the surface tension of the coating liquid from forming thick beads at the edges of the freely dropping curtain C.

Figure 2:
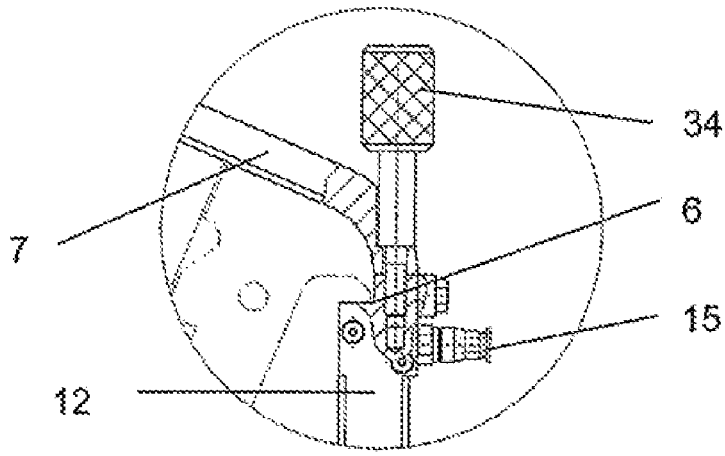
FIG. 2 is an enlarged detail view at the overflow edge of the application surface.

As described in U.S. Pat. No. 7,081,163 the bar-shaped guides 7 and 12 each have a flat inner face turned toward the curtain C. A wetting agent, for example water or the actual curtain liquid, is sprayed on the inner face of each guide 7 and 12 to hold the curtain on the guides 7 and 12. The wetting agent is fed in through a passage 14 that opens slightly above the overflow edge 6 of the flow face 8 and that is connected as shown in FIG. 2 to a supply line 15. The lower end of each guide 12 is provided with a suction element 16 whose face turned toward the curtain C is aligned with the inner face of the guide 12. The curtain edge flows without disturbance down along the guide 12 and the suction element 16 to the web 13. A suction line is connected to the suction element 16 from outside by a suction passage 17 opening at a suction slot 18. The suction slot 18 extends perpendicular to the curtain C and has a length parallel to the web-travel direction D of between 0.5 mm and 15 mm, preferably 0.5 mm to 1 mm, and is so positioned on the lower face of the suction element 16 that it is spaced between 0.5 mm and 3 mm from the web 13. To maintain this spacing, the suction passage 18 is downwardly closed by a thin floor 19 slightly inclined to the web 13 and ending in the suction slot 18 at a sharp edge. The aspiration of the thick edge of the coating material thus is effective horizontally. At the same time the sharp edge ensures constant release of the coating material without the so-called "tea-pot effect." To prevent deposits from forming in the suction slot 18, it is flushed with an appropriate rinse liquid, for example water. To this end two flush lines 20 extend generally parallel to the suction line toward the suction slot 18. The rinse liquid is carried off with the aspirated coating material via the suction line 17.

Figure 3:
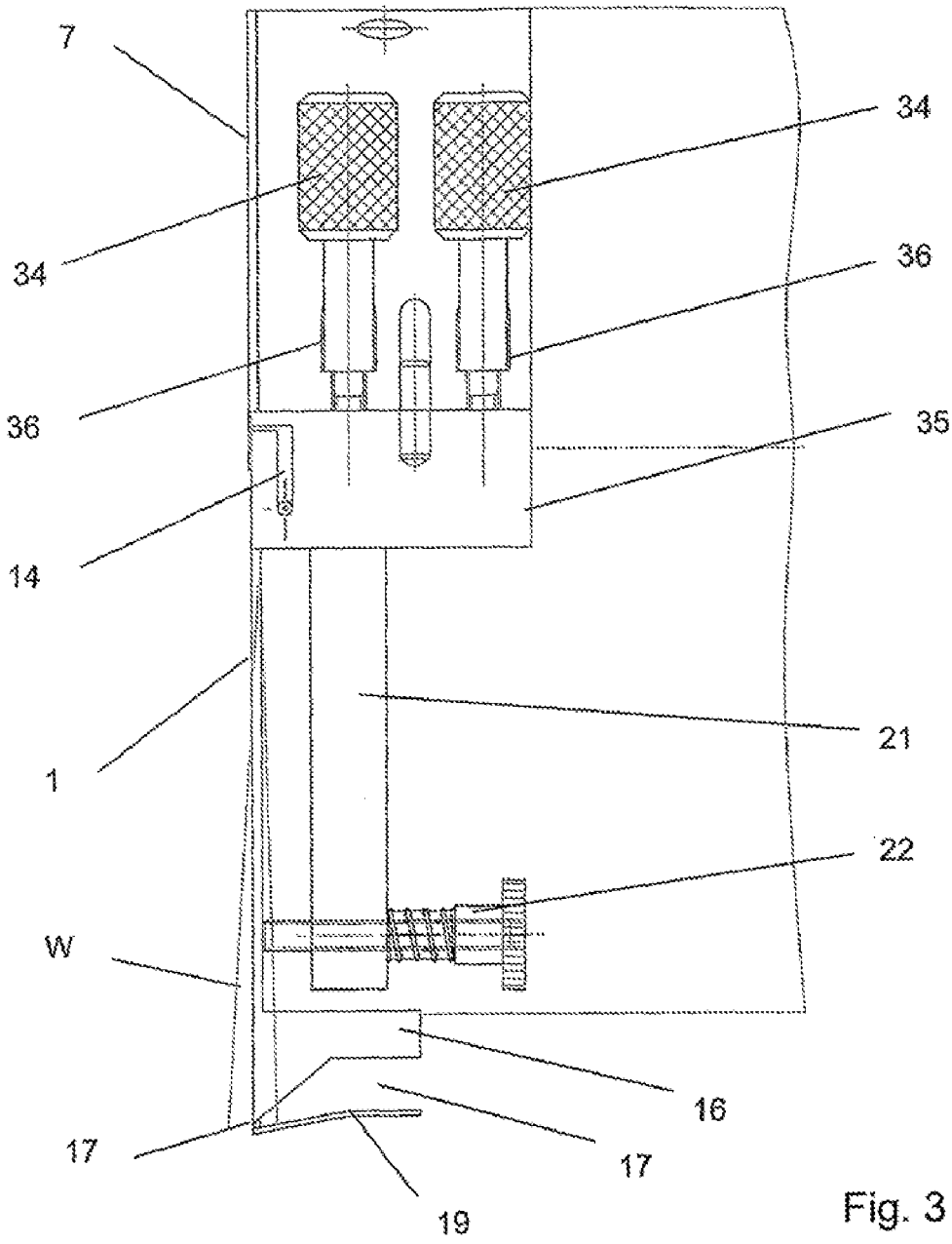
FIG. 3 shows the edge of the slide hopper in a view taken against the web-travel direction.

In order that the edge of the curtain C engaging the web 13 can be limitedly adjusted crosswise of the web-travel direction D, the two guides 12 are made at their lower portions defining the curtain C of a limitedly flexible and elastic material, preferably of spring steel, as shown in FIG. 3. To brace and position each guide 12, there is a downwardly extending brace bar 21 parallel to and offset outward from the guide 12. The brace bar 21 is in all cases more rigid than the guide 12 and made, for example, of stainless steel and ends at a slight spacing short of the suction element 16. An adjustment screw 22 that can be moved against the guide 12 is provided at the lower end region of the brace bar 21. The screw 22 makes it possible to position the free end of the guide and the suction element 16 fixed to it limitedly transversely of the web-travel direction in order to set the exact position of the suction slot 18. In addition the screw 22 also allows the shape of the guide 12 to be varied within limits in order to optimize the guiding and adherence of the curtain edge.

The guides 7 and 12 with the elements fixed to them can be steplessly positioned transversely along the flow face 8 as shown in FIG. 4. The lower guide 12 is fixed to a cover plate 23. The edge of the cover plate 23 turned toward the curtain also forms the upper guide 7. Brackets 24 fixed to the cover plate 23 are mounted on a linear mount 25. The linear mounts 25 are in turn fixed on a support plate 26. The support plate 26 can be slid manually or automatically along a straight guide 27. FIG. 5 shows how the support plate 26 fits with the straight guide 27. FIG. 5 also shows that a bent-out lower part of the plate 26 is fixed to a further lateral support plate 28. Guide rods 29 on whose ends are secured inserts are guided and fixed in the lateral support plate 28. The guide rods 29 extend into the distribution chambers and are surrounded by radial seals in a seal plate 30.

The cover plate 23 is shifted forward across the web-travel direction by the linear mount 25 to adjust the width of the curtain C. This lifts the cover plate 23 from its in-use position lying on the flow face 8. It is also possible to pivot the cover plate 23 at its downstream edge so that the cover plate 23 can be lifted off the slide face. Then, to set the coating width the support plates 26 and 28 are moved perpendicular to the curtain C. This can be done manually by simply pushing or pulling the support plates 26 and 28 or can be done by means of an unillustrated actuator. As the support plates 26 and 28 move they slide in guides that are connected with the linear guide 27. At the same time the guide rods 29 are shifted into or out of the seal plate 30. Inserts 31 are secured at the ends of the guide rods 29. The inserts 31 are guided in the distribution chambers 2 and extend in the distribution chambers 2 to a position aligned with the inner edge of the cover plate that forms the upper guide 7. The inserts 31 are preferably made of plastic and are provided with threaded inserts 32 in which the respective guide rods 29 are fixed. The inserts 31 limit the dimension of the respective distribution chambers parallel to the curtain and thus limit the width of the outlet slot 9. After shifting the support plates 26 and 28 the cover plate 23 is pulled back by means of the linear mount so that the cover plate 23 lies directly on the flow face 8. The cover plate 23 serves at its edge turned toward the curtain again as the upper guide 7 and also as a seal for the outlet slot 9 above the insert 31 and outside the coating width to seal the distribution chamber 2 that should not be filled with the coating liquid.

The space outside the inserts 31 in the chambers 2, that is the region remote from the curtain C, can if necessary be filled with a helper liquid. The nozzle can be used with or without this helper liquid in the space outside the inserts 31. FIG. 5 shows an angle fitting 33 in the seal plate 30 for supplying the helper liquid to the distribution chambers, and this helper liquid can also be fed via the guide rods 29 to the slide face of the inserts 31. The pressurized helper liquid in the distribution chambers 2 outside the inserts 31 ensures that the inserts 31 do not get stuck or that the coating liquid for the curtain 3 does not form deposits on the inserts 31 and wedge these inserts 31 in place.

The helper liquid also ensures that adjustment of the width of the outlet slot 9 is always possible. This makes it possible to steplessly adjust the width of the outlet slot 9, and thus the width of the flow face 8, at any time with no disassembly. It is of course understood that the described width adjustment takes place on both sides of the nozzle, since both sides are spectrally identical.

Figure 6:
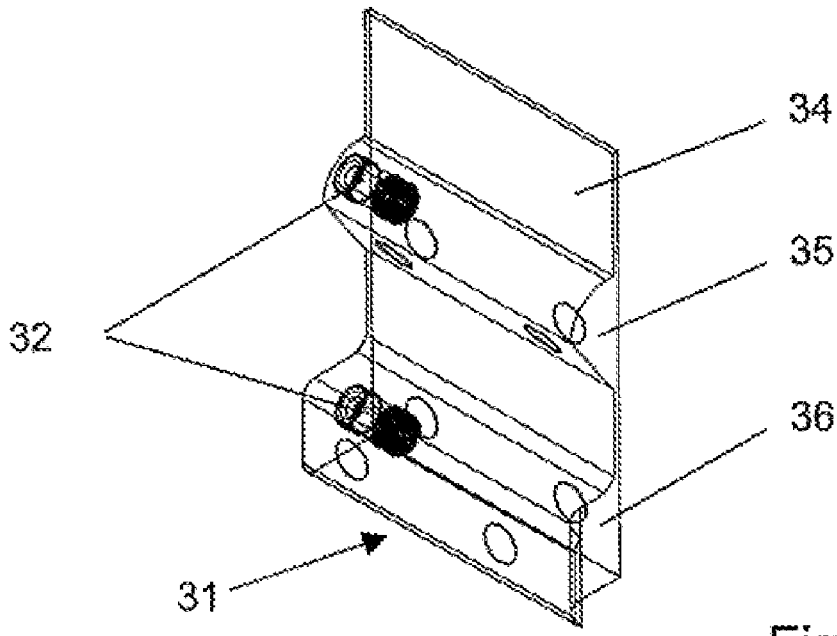
FIG. 6 shows an adjustable insert for limiting the chamber width.

The construction of the insert 31 is shown in FIG. 6. The insert 31 is formed for example of plastic and has preferably metallic threaded inserts 32. A thin base plate 34 is formed with a triangular-section body 35 and a square-section body 36. The upper part of the base plate 34 extends into the outlet slot 9 and the bodies 35 and 36 act as seal bodies in the distribution chambers 2. The guide rods 29 are threaded into the inserts 32. The opposite face of the insert 31 delimits the respective distribution chamber 2 to the desired coating width of the curtain. The insert 31 thus laterally closes the outlet slot 9 and the distribution chamber 2 that are filled with the coating solution of the curtain C, while the helper liquid behind the insert 31 prevents jamming of the insert 31.

The insert 31 is slid by two guide rods 29 that are anchored at one end in the insert 31 and at the other end in the respective lateral support plate 28. The lateral support plates 28 flank the liquid hopper 1 and are each fixed to the respective support plate 26 so that they can be moved jointly therewith transverse to the web-travel direction by a drive. The inserts 31 fixed to the guide roads 29 are so positioned that the width of the distribution chamber 2 is exactly the same as that of the flow face 8 and of the curtain C. The coating liquid only exits with a width that corresponds to the desired width of the coating. This ensures that with any given coating width, no coating material is lost or needs to be recirculated.

In order to prevent the inserts 31 from sticking in the distribution chambers 2 during use so that they cannot be moved, they are wetted from outside with a rinse liquid, for example water or a solvent. To this end the seal wall 30 is formed with passages that lead to the individual distribution chambers 2 and that connect to the angle fittings 33 for the rinse liquid. Preferably the inserts 31 fit with slight play in the distribution chambers 2 so that some rinse liquid can get past and through the outlet slot 9 to the flow face, preferably the rinse liquid is fed under pressure into the distribution chambers. The rinse liquid can also serves as helper liquid for the curtain edges to improve adherence to the guides 7. In some applications the separate feed of helper liquid to the guide 7 can be eliminated. The rinse and helper liquids thus flow over the flow face 8 to the inner faces of the guides 9 down to the lower guides 13 and ensure constant adherence of the curtain edges.

FIGS. 1, 2, and 3 show the construction and mounting of the lower guide 12 on the cover plate 23. The guide 12 is releasably mounted on the cover plate 23 by means of a knurled-head screw 34. The user thus can very quickly disconnect the guide 12 from the cover plate 23. The guide 12 on each side has two knurled-head screws 34, a seat plate 35, the brace bar 21 with the adjustment screw 22, and the lower guide 12 and the suction element 16 on the lower end of the guide 12. The two screws 34 are held in seats 36 and engage with their threaded shafts into the seat plate 35 as shown in section in FIG. 2. The lower end of the seat plate 35 is fixed to the brace bar 21. The lower guide 12 on the other hand is movable relative to the brace bar 21. The guide 12 can be adjusted transversely to the curtain C by means of the screw 22 through a limited angular travel shown at W in FIG. 3.

The invention claimed is:

1. An apparatus for applying a coating liquid to a web moving in a travel direction, the apparatus comprising:

a hopper defining a distribution chamber extending transversely of the direction, a flow face extending generally in and transverse to the web-travel direction, a slot extending between the chamber and the flow face and elongated transversely of the direction;

means for supplying the coating liquid to the chamber, thence through the slot to the flow face, and thence along the flow face and for dropping the liquid as a transversely extending and downwardly flowing curtain from an edge of the flow face onto the web;

a pair of transversely spaced edge guides having upper guide elements having transversely confronting faces and fittable complementarily to the flow face, the upper guide elements lying in a use position substantially directly on the flow face to limit liquid flow to a region thereon defined between the transversely confronting faces that hence define the width of the curtain;

means for transversely positioning the edge guides and thereby adjusting the curtain width; and respective lower guide elements each having an inner face aligned vertically with the face of the respective upper guide element, the lower guide elements being fixed to and transversely displaceable with the respective upper guide elements.

2. The coating apparatus defined in claim 1, further comprising means at lower ends of the lower guide elements for aspirating the coating liquid.

3. The coating apparatus defined in claim 1, further comprising means for releasably securing the lower guide elements to the respective upper guide elements.

4. The coating apparatus defined in claim 3 wherein the releasable securing means includes finger-operable screws.

5. The coating apparatus defined in claim 1 wherein the flow-face edge is curved and fits with the upper guide element.

6. The coating apparatus defined in claim 1 wherein the flow face inclines downward from the slot to the edge.

7. The coating apparatus defined in claim 1 further comprising:

a pair of transversely spaced inserts each substantially blocking the slot and the chamber; and means for transversely displacing the inserts and thereby setting a transverse width of the chamber and slot.

8. An apparatus for applying a coating liquid to a web moving in a travel direction, the apparatus comprising:

a hopper defining a distribution chamber extending transversely of the direction, a flow face extending generally in and transverse to the web-travel direction, a slot extending between the chamber and the flow face and elongated transversely of the direction, and a supply passage opening generally centrally into the chamber;

means connected to the passage for supplying the coating liquid centrally to the chamber, thence through the slot to the flow face, and thence along the flow face and for dropping the liquid as a transversely extending and downwardly flowing curtain from an edge of the flow face onto the web;

a pair of transversely spaced edge guides having upper guide elements having transversely confronting faces and fittable complementarily to the flow face, the upper guide elements lying in a use position substantially directly on the flow face to limit liquid flow to a region thereon defined between the transversely confronting faces that hence define the width of the curtain;

means for transversely positioning the edge guides and thereby adjusting the curtain width;

a pair of transversely spaced inserts each substantially blocking the slot and the chamber;

means for transversely displacing the inserts and thereby setting a transverse width of the chamber and slot; and structure linking the inserts to the respective guides for joint transverse displacement therewith, the inserts having confronting inner faces aligned vertically with the faces of the respective upper guide elements.

9. The coating apparatus defined in claim 8 wherein the hopper includes end plates laterally flanking the inserts and the chambers, the structure including rods passing transversely through the end plates and having inner ends fixed to the inserts.

10. The coating apparatus defined in claim 8, further comprising means for lifting the upper guide elements off the flow face during transverse displacement of the upper guide elements.

* * * * *